US006712002B2

(12) United States Patent
Herbst et al.

(10) Patent No.: US 6,712,002 B2
(45) Date of Patent: Mar. 30, 2004

(54) METHOD AND APPARATUS FOR INK FEED CONTROL

(75) Inventors: Sonke Herbst, Ostrich-Winkel (DE); Elmar Jung, Hainburg (DE); Uwe Puschel, Heidescheim (DE); Peter Schramm, Frankfurt/Main (DE)

(73) Assignee: MAN Roland Druckmaschinen AG, Offenbach/Main (DE)

( * ) Notice: Subject to any disclaimer, the term of this patent is extended or adjusted under 35 U.S.C. 154(b) by 0 days.

(21) Appl. No.: 10/382,338

(22) Filed: Mar. 5, 2003

(65) Prior Publication Data

US 2003/0172825 A1 Sep. 18, 2003

(30) Foreign Application Priority Data

Mar. 6, 2002 (DE) ..... 102 09 861

(51) Int. Cl.[7] ..... B41F 31/00

(52) U.S. Cl. ..... 101/351.1; 101/138; 101/217; 101/247

(58) Field of Search ..... 101/137, 138, 101/139, 140, 144, 145, 148, 216, 217, 247, 350.1, 350.3, 350.5, 352.05, 182, 183, 184, 185, 492

(56) References Cited

U.S. PATENT DOCUMENTS 4,088,074 A * 5/1978 Dahlgren et al. ..... 101/350.5
4,109,574 A * 8/1978 Förster et al. ..... 101/216
4,240,346 A * 12/1980 Landis et al. ..... 101/139
4,520,729 A * 6/1985 Fischer ..... 101/352.05
4,524,692 A * 6/1985 Rodvelt ..... 101/350.1
4,577,556 A * 3/1986 Fischer ..... 101/148
4,577,557 A * 3/1986 Fischer ..... 101/217
5,081,926 A 1/1992 Rodi
5,170,706 A * 12/1992 Rodi et al. ..... 101/148
6,205,926 B1 * 3/2001 Dufour ..... 101/492
6,272,986 B1 * 8/2001 Hess ..... 101/137
6,425,326 B1 * 7/2002 Dorenkamp ..... 101/351.1
6,578,481 B1 * 6/2003 Beisel et al. ..... 101/350.3

FOREIGN PATENT DOCUMENTS

DE 36 40 295 A1 10/1987
DE 40 13 740 A1 1/1992

* cited by examiner

*Primary Examiner*—Eugene H. Eickholt
(74) *Attorney, Agent, or Firm*—Leydig Voit & Mayer, Ltd.

(57) ABSTRACT

A printing machine having an inking unit which prevents overinking of the printing cylinder upon increases in printing speed, such as during start-up of a printing operation. The inking unit includes an ink supply, two roll trains each comprising a plurality of inking rolls for communicating ink from the ink supply to a plurality of ink applicator rolls associated with the printing cylinder, with at least one inking roll in each roll train being displaceable in phase with an increase in printing speed for interrupting the respective roll train and preventing excessive ink application to the printing cylinder.

10 Claims, 4 Drawing Sheets

METHOD AND APPARATUS FOR INK FEED CONTROL

FIELD OF THE INVENTION

The present invention relates generally to printing machines, and more particularly to an apparatus and method for controlling the ink feed in such machines.

BACKGROUND OF THE INVENTION

In sheet-fed offset printing machines, the ink feed is carried out from an ink fountain, interacting with an ink fountain roll and ink metering elements. Zonally metered ink on the ink fountain roll is transferred via a doctor roll to a first distributor roll and, from there, via a number of rolls to a plurality of ink applicator rolls set against the plate cylinder.

In order to achieve a uniform ink layer thickness application to a printing plate clamped on the plate cylinder and, in this way, to obtain an ink density which is uniform over the print length, the front and rear ink applicator rolls in the printing direction each are connected to a respective roll train. Such a two-train inking unit is shown, for example, by DE 40 13 740 C2.

When rotational speeds of the printing cylinders are increased, in particular following production interruptions, the first printed sheets normally exhibit clearly visible overinking. In the case of printed subjects with a high ink coverage area this effect is especially pronounced. In order to counteract such overinking, attempts often are made to reduce the ink feed, which can be done for example by closing the ink metering elements or stopping the doctor roll. However, these measures require a lead time which must be coordinated exactly with the ink flow and the printing speed, since the inertia of the inking unit is relatively high. That is to say, the interruption to the ink flow is effected only after some machine revolutions.

Inking units of sheet-fed offset printing machines frequently also have what are known as ink flow separators which can interrupt the roll train at one or more points. Such ink flow separators are used during printing interruptions to prevent the ink layer thickness profile from breaking down as the inking unit continues to run. When printing is started, however, the rolls are set against one another again so that the original ink flow again is produced.

DE 36 40 295 C2 discloses a method for avoiding the overinking of inking units on printing machines, in which, during the printing operation, an ink applicator roll is thrown off, separated from the roll train and washed during this phase. In this way, from time to time excess ink from the inking unit can be dissipated.

OBJECTS AND SUMMARY OF THE INVENTION

It is an object of the invention to provide a method and apparatus for more accurately controlling the ink feed in a printing machine.

Another object is to provide a method and apparatus as characterized above that is effective for preventing overinking of printing material when the speed of the printing machine is increased, such as during start up of the printing operation.

According to the invention, in a phase in which the printing speed is increased, provision is made for interrupting the roll train at least for some time, at at least one point.

As a result of this interruption of the roll train, an excess of ink built up in the inking unit, for example as a result of a previous print interruption, cannot produce overinking on the printed sheets.

According to one embodiment of the invention, in an inking unit that supplies the applicator rolls with ink via two roll trains, the two roll trains are divided or interrupted at at least one point as the rotational speed is increased. The dividing point, which may be in a lower part of the inking unit, results in a specific measure and application that can be coordinated accurately with the printing conditions in order to avoid overinking.

According to a further embodiment of the invention, in an inking unit supplying the applicator rolls with ink via two roll trains, the ink supply of the front ink applicator rolls in the printing direction remains unchanged, while provision is made for briefly uncoupling the rear ink applicator rolls during the acceleration phase. This corresponds to a brief changeover to what is known as a frontloaded inking unit, in which the main quantity of ink fed in is applied on the first or the first two ink applicator rolls (as viewed in the direction of rotation of the plate cylinder). In this case, the method according to the invention is preferably carried out during the production start-up phase, in which the printing speed also is increased.

Other objects and advantages of the invention will become apparent upon reading the following detailed description and upon reference to the drawings, in which:

Figure 1:
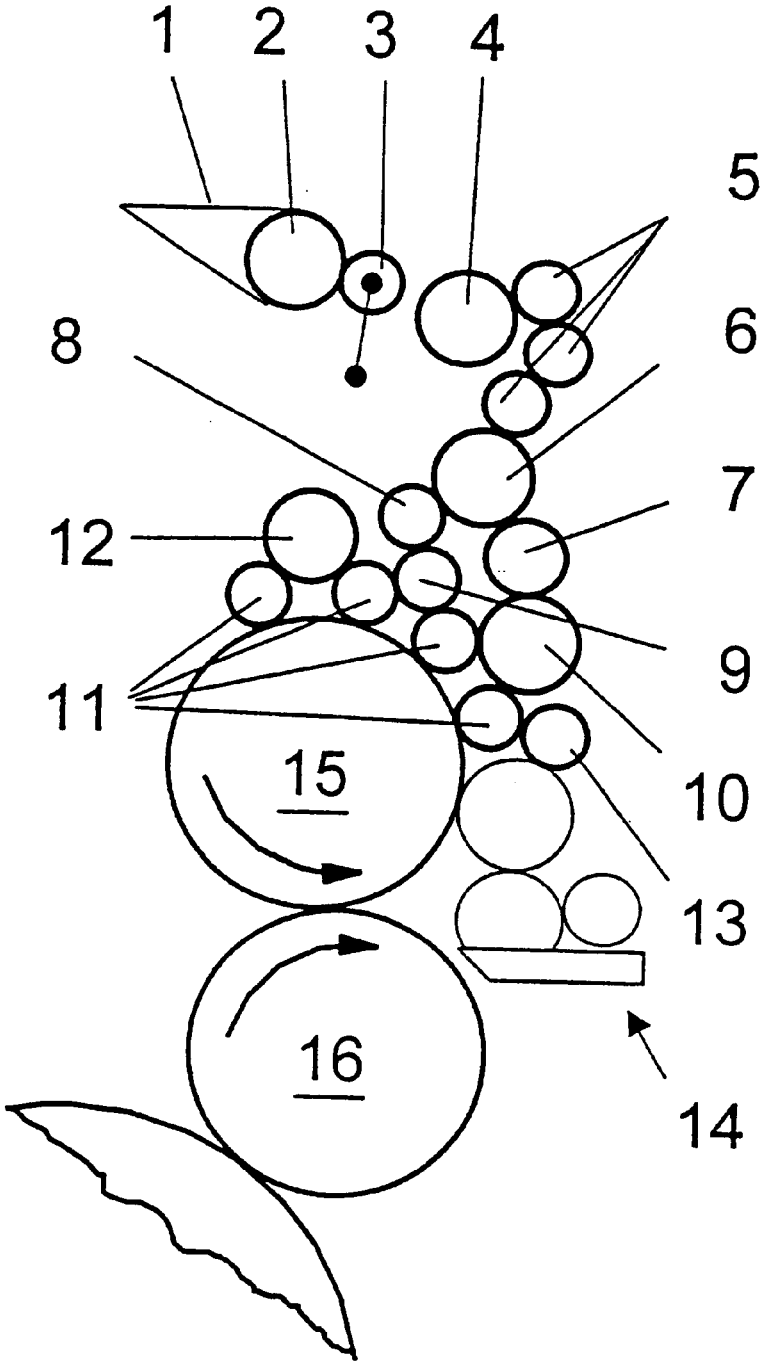
FIG. 1 is a partially diagrammatic depiction of a sheet-fed offset printing machine having an inking unit in accordance with the invention.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DETAILED DESCRIPTION OF THE PREFERRED EMBODIMENT

Referring now more particularly to FIG. 1 of the drawings, there is shown an illustrative sheet-fed offset printing machine having an inking unit in accordance with the invention. The printing machine includes a plate cylinder 15 having an adjacent blanket cylinder 16 and a plurality of ink applicator rolls 11 disposed in circumferentially spaced relation about the plate cylinder 15. Four ink applicator rolls 11 in this case are provide which includes, as viewed in the direction of plate cylinder rotation, a front or upstream applicator roll to the right as viewed in FIG. 1, a downstream or last applicator roll to the left as viewed in FIG. 1, and two intermediate applicator rolls.

The inking unit includes an ink fountain 1 which applies ink zone by zone to a fountain roller 2 by means of appropriate metering elements in a known manner, and in turn, to a doctor roll 3 that swings to and from between the ink fountain roll 2 and a distributor roll 4 arranged downstream thereof. Ink is transported from the distributor roll 4 and to a plurality of downstream inking rolls 5.

A second distributor roll 6, as seen in the ink flow direction, splits the ink stream via two downstream inking rolls 7, 8 into two ink trains. Via the inking roll 7, ink is fed to a distributor roll 10 and the front or upstream applicator rolls 11, as viewed in the direction of rotation of the plate cylinder 15. Via the inking roll 8, an ink layer from the distributor roll 6 is fed to a bridging roll 9, and from there, to the last or downstream ink applicator rolls 11, as viewed in the direction of rotation of the plate cylinder 15. In this case, the last ink applicator roll 11 receives ink from the penultimate (second to last) ink applicator roll 11 via an inking roll 12. A damping unit 14 in this case is provided which communicates with the front or upstream applicator roll 11 via the bridging roll 13.

Figure 2:
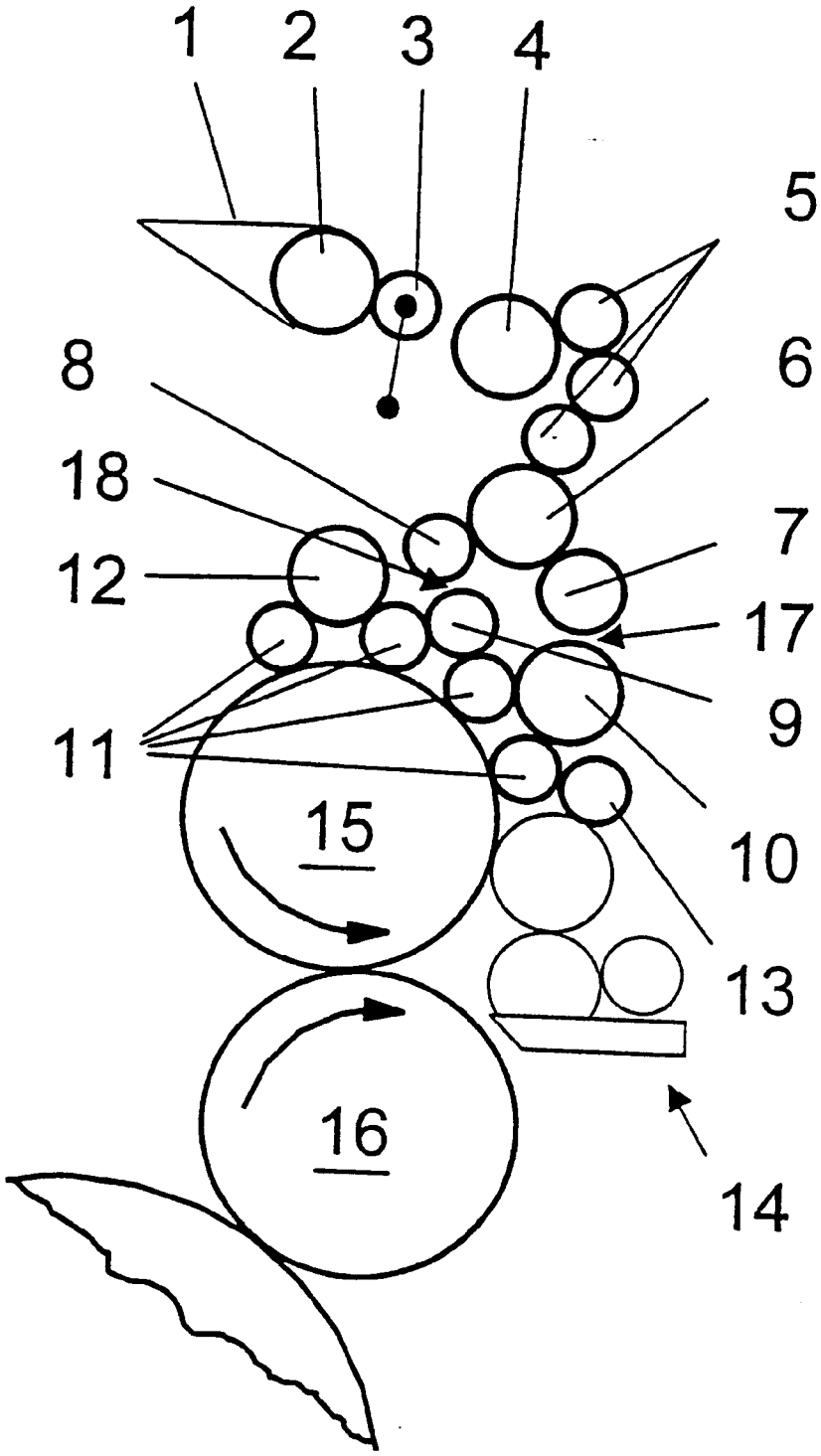
FIG. 2 is a side elevational view of the printing machine shown in FIG. 1, with dual ink roll trains in a divided or interrupted condition during a sheet start-up operation.
Figure 4:
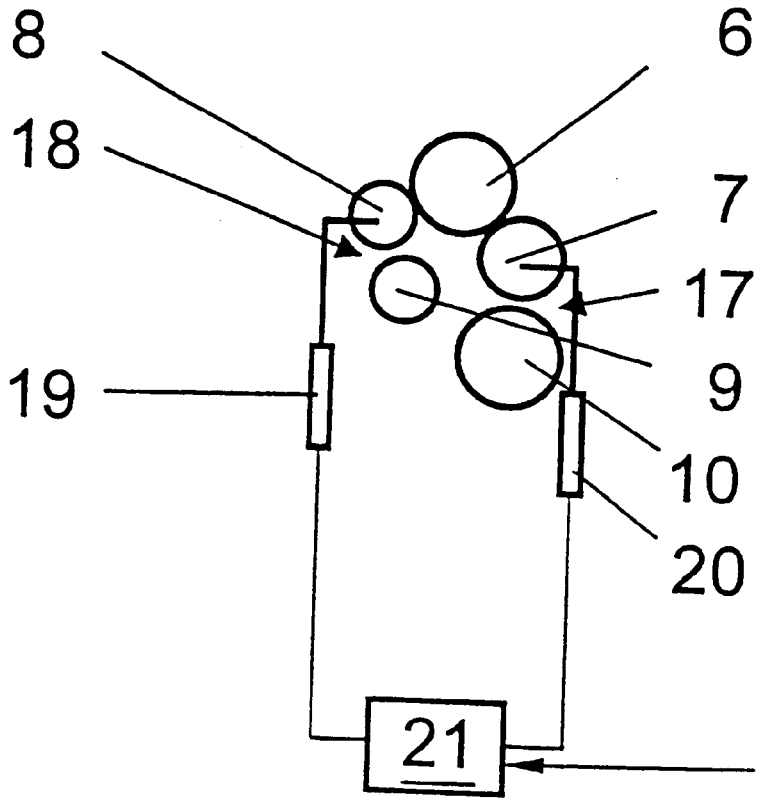
FIG. 4 is a diagrammatic depiction of a control for the inking unit of the illustrated machine.

In accordance with the invention, a method and apparatus is provided for controlling the ink flow to the ink applicator rolls, and hence the plate cylinder, for preventing undesirable ink build up upon a change in operating speed of the printing machine, such as during start up following a production interruption. More particularly, at least one of the ink trains to the printing cylinder applicator rolls is divided or interrupted in phase with changes or increases in printing speed of the machine to prevent against excessive ink transfer to the plate cylinder. In the illustrated embodiment as shown in FIG. 2, at least one inking roll 7, 8 in each roll train is movable to a throw-off position for interrupting the ink flow in such roll train in phase with an increase in printing speed. Each roll 7, 8 may have an appropriate respective actuator 19, 20, as depicted in FIG. 4, for throwing the roll off to create a cap 5 between the rolls 7, 10 and 8, 9 and respective dividing or interruption points 17, 18 in the two ink flow streams.

Figure 3:
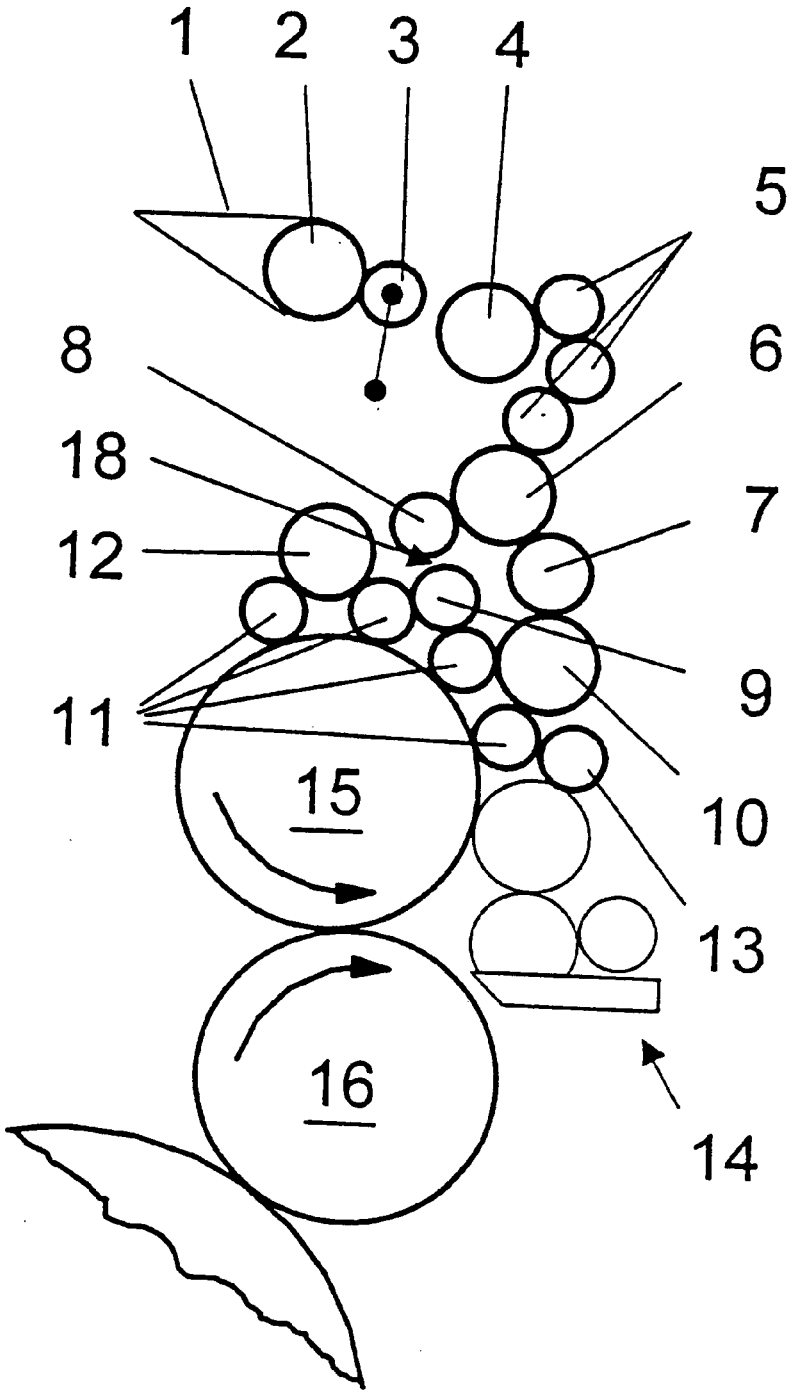
FIG. 3 is a diagrammatic depiction of the illustrated printing machine with one of the ink roll trains divided or interrupted such that lesser ink is supplied to downstream ink applicator rolls, as viewed in the direction of the printing cylinder rotation.

Alternatively, as viewed in FIG. 3, during an increase in printing speed, only one of the ink trains may be interrupted or divided, such as the ink train supplying ink to downstream or last ink applicating rolls, as viewed in the direction of plate cylinder rotation As seen in FIG. 3, this is effected by operating the actuator 19 for the inking roll 8 to create the dividing point 18 between the rolls 8, 9. In such case, the division between rolls 7, 10 remains unactivated or intact such that the front applicator rolls, as viewed in the direction of plate cylinder rotation, are supplied with ink while the last applicator rolls 11 receive only a very low ink flow via the inking roll 9.

It will be appreciated by one skilled in the art that the actuators 19, 20 for the displaceable ink rolls 7, 8 may be controlled by a controller 21 which receives signals from a main controller of the printing machine, such as when the printing speed is increased. The signal may be directed to the controller from the machine control, as depicted by the arrow in FIG. 4. Upon actuation of both of the actuators 19, 20, the roll 7, 8, respectively, may be displaced to inactive or removed positions for creating the gaps or interruptions in the respective ink trains. The roll 7, 8 in this case are thrown off the rolls 9, 10, respectively, while maintaining contact with the distributor roll 6. It will be understood by one skilled in the art that displacement of the rolls 7, 8 by means of the actuators 19, 20, as depicted in FIG. 4, is exemplary. Actuating means 19, 20 could be provided for other rolls in the respective roll trains, such as the roll 6 for interrupting the ink trains at two points in phase with an increase in the printing speed.

From the foregoing, it can be see that the ink unit of the present invention is adapted for more accurately controlling ink feed in the printing machine during changes in the speed of operation. The method and apparatus of the present invention is particularly adapted for preventing overinking of printing material when the speed of the printing machine is increased such as during start up of a printing operation.

What is claimed is:

1. A method of controlling the ink feed to a printing cylinder of a variable speed printing machine having an inking unit with an ink supply, a roll train comprising a plurality of inking rolls in contact with each other communicating with the ink supply, and at least one ink applicator roll communicating between said ink train and said printing cylinder comprising the steps of communicating ink from said ink supply to said printing cylinder via said roll train when said printing machine is operated at one printing speed, and interrupting said roll train at at least one point for at least some time in phase with an increase in printing speed for preventing excessive ink application to the printing cylinder.

2. The method of claim 1 including interrupting said roll train by displacing an inking roll in said roll train to a throw out position.

3. The method of claim 1 including supplying ink from said ink supply to said printing cylinder via two roll trains when said printing machine is operated at said one printing speed, and interrupting the ink flow in each roll train in phase with an increase of printing speed of the printing machine.

4. The method of claim 1 including supplying ink from said ink supply to said printing cylinder via two roll trains when said printing machine is operated at said one printing speed, and interrupting the ink flow in one of the said roll trains in the phase with an increase in printing speed of said machine.

5. The method of claim 1 including communicating ink between said ink supply via two roll trains and a plurality of ink applicator rolls, and interrupting the ink supply through selected of said roll trains in phase with an increase in printing speed.

6. The printing machine of claim 1 including a controller for receiving signals from the printing machine in phase with an increase in printing speed of the machine, and said controller being responsive to said signal to actuate the said actuator for moving said at least one roll in said roll train for interrupting said roll train.

7. The method of supplying ink to a printing cylinder of a variable speed printing machine having an ink supply and a printing cylinder with at least one ink applicator roller associated with the printing cylinder, comprising the steps of supplying ink to said printing cylinder via a roll train communicating between said ink supply and said at least one applicator roller during one printing speed, and interrupting said roll train in phase with an increase in printing speed of the printing machine to prevent the supply of excessive ink to said printing cylinder.

8. A variable speed printing machine comprising a printing cylinder, at least one applicator roll adjacent the printing cylinder for applying ink to the printing cylinder, an inking unit having an ink supply and a roll train having a plurality of inking rolls for communicating ink between said ink supply and said at least one inking applicator roll, and an actuator for moving at least one roll in said roll train to a thrown off position in phase with an increase in the printing speed of the printing machine for interrupting the ink flow through said roll train to said applicator roll.

9. The printing machine of claim 8 in which said inking unit includes two ink roll trains for supplying ink from said ink supply to said at least one applicator roll, and at least one roll in each roll train being movable in phase with an increase in printing speed for interrupting the ink flow through the respective roll train.

10. The printing machine of claim 8 in which said inking unit includes two roll trains for supplying ink from said ink supply to said at least one applicator roll, and an ink roll in at least one of said roll trains is movable in phase with an increase in printing speed for interrupting the flow of ink through said at least one roll train while ink continues to communicate through the other roll train.

* * * * *